US009989247B2

(12) United States Patent
Cao et al.

(10) Patent No.: US 9,989,247 B2
(45) Date of Patent: Jun. 5, 2018

(54) PYROLYSIS-COMBUSTION DUAL-BED SYSTEM FOR ELIMINATING CONTAMINATION BY COMBUSTION OF HIGH-SODIUM COAL

(71) Applicant: DONGFANG ELECTRIC CORPORATION, Chengdu, Sichuan (CN)

(72) Inventors: Liyong Cao, Sichuan (CN); Qi Du, Sichuan (CN); Wei Fan, Sichuan (CN); Zhengning Liu, Sichuan (CN); Pan Guo, Sichuan (CN); Jiang Liu, Sichuan (CN); Yuan Zhang, Sichuan (CN); Chunfei Zhang, Sichuan (CN); Chunyun Hu, Sichuan (CN); Xiaoguang Zhang, Sichuan (CN); Yu Lei, Sichuan (CN)

(73) Assignee: DONGFANG ELECTRIC CORPORATION (CN)

( * ) Notice: Subject to any disclaimer, the term of this patent is extended or adjusted under 35 U.S.C. 154(b) by 295 days.

(21) Appl. No.: 14/425,662

(22) PCT Filed: Sep. 25, 2013

(86) PCT No.: PCT/CN2013/084225
§ 371 (c)(1),
(2) Date: Mar. 4, 2015

(87) PCT Pub. No.: WO2014/048329
PCT Pub. Date: Apr. 3, 2014

(65) Prior Publication Data

US 2015/0292734 A1 Oct. 15, 2015

(30) Foreign Application Priority Data

Sep. 25, 2012 (CN) ..... 2012 1 0360012

(51) Int. Cl.
*F23C 10/10* (2006.01)
*F23C 10/22* (2006.01)
(Continued)

(52) U.S. Cl.
CPC ..... *F23C 10/10* (2013.01); *F23C 10/22* (2013.01); *F23J 1/02* (2013.01); *F23J 15/02* (2013.01)

(58) Field of Classification Search
CPC .. F23C 10/10; F23C 10/22; F23J 15/02; F23J 1/02
See application file for complete search history.

(56) References Cited

U.S. PATENT DOCUMENTS 4,788,917 A * 12/1988 Hogue ..... C21B 5/006 110/203

FOREIGN PATENT DOCUMENTS

CN 1030291 A 1/1989
CN 2376579 5/2000
(Continued)

OTHER PUBLICATIONS

International Search Report for International Patent Application No. PCT/CN2013/084225, dated Jan. 9, 2014.

*Primary Examiner* — Alfred Basichas
(74) *Attorney, Agent, or Firm* — McAndrews, Held & Malloy, Ltd.

(57) ABSTRACT

A pyrolysis-combustion dual-bed system comprises a fluidized bed, a cyclone separator, a coal ash distributor, an ash-coal mixer, a lower pyrolysis bed, a return feeder and a cleaner, wherein the cyclone separator is connected with an upper lateral side of the fluidized bed, the outlet end of the cyclone separator is connected with the inlet end of the coal ash distributor; the two outlets of the lower pyrolysis bed are respectively connected with the inlet of an external bed and
(Continued)

the inlet of the cleaner; the outlet of the external bed is connected with the inlet of the return feeder; the return feeder close to the lower lateral side of the fluidized bed is connected with the inlet on the lower lateral side of the fluidized bed; and the outlet of the cleaner is connected with the inlet of the lower lateral side of the fluidized bed.

16 Claims, 1 Drawing Sheet

(51) Int. Cl.
*F23J 1/02* (2006.01)
*F23J 15/02* (2006.01)

(56) References Cited

FOREIGN PATENT DOCUMENTS

| | | | |
|---|---|---|---|
| CN | 2527866 | Y | 12/2002 |
| CN | 1667086 | | 9/2005 |
| CN | 1727750 | | 2/2006 |
| CN | 1754945 | | 4/2006 |
| CN | 200996005 | | 12/2007 |
| CN | 101255987 | A | 9/2008 |
| CN | 101353582 | | 1/2009 |
| CN | 102095195 | A | 6/2011 |
| CN | 102425789 | A | 4/2012 |
| CN | 102829473 | | 12/2012 |
| CN | 202813357 | | 3/2013 |
| JP | 2005308382 | A | 11/2005 |
| WO | 2011060556 | | 5/2011 |

* cited by examiner

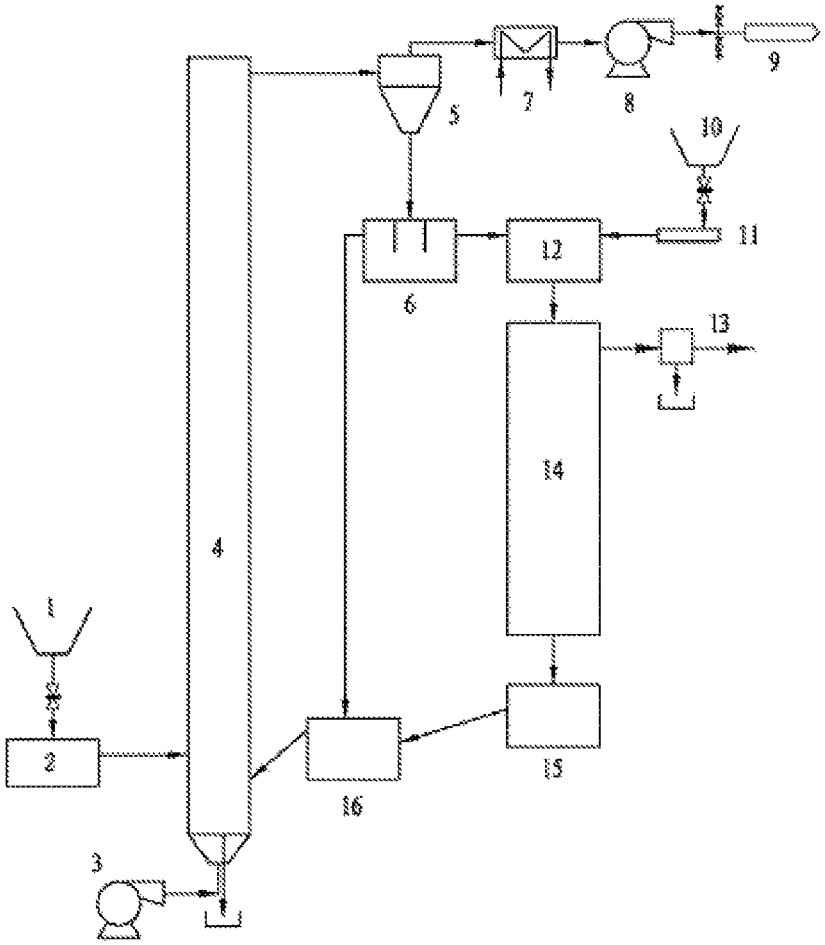
1
2
3
4
5
6
7
8
9
10
11
12
13
14
15
16

PYROLYSIS-COMBUSTION DUAL-BED SYSTEM FOR ELIMINATING CONTAMINATION BY COMBUSTION OF HIGH-SODIUM COAL

CROSS-REFERENCE TO RELATED APPLICATIONS/INCORPORATION BY REFERENCE

This application is a 371 of International Patent Application No. PCT/CN2013/084225, filed Sep. 25, 2013, entitled "SYSTEM FOR SOLVING HIGH-SODIUM COAL COMBUSTION CONTAMINATION BY USING PYROLYSIS-COMBUSTION DUAL-BED", which claims priority to Chinese Patent Application No. 201210360012.6, filed Sep. 25, 2012, entitled "SYSTEM FOR SOLVING HIGH-SODIUM COAL COMBUSTION CONTAMINATION THROUGH PYROLYSIS COMBUSTION DOUBLE-BED". The above-identified applications are hereby incorporated herein by reference in their entirety.

TECHNICAL FIELD OF THE INVENTION

The disclosure relates to a technology related to relieving the contamination to a boiler heating surface and more particularly to a pyrolysis-combustion dual-bed system for eliminating the contamination caused by the combustion of a high-sodium coal.

BACKGROUND OF THE INVENTION

Thermal power generation plays a major role in China's domestic power generation industry, the installed thermal power capacity being higher than 70%. The use of low-quality low-grade coals as power coals by most of thermal power plants causes the slagging on the water wall of a boiler furnace and the slagging and fouling on a convective heat-absorbing surface, which is one of the major problems affecting the normal running of the boiler in a power station. The slagging and fouling will reduce the heat transfer efficiency of the boiler, lower the output of the boiler and impair the operation security of a device, and a severe slagging may even lead to the flameout of a furnace, a pipe bursting, an unscheduled boiler shutdown and other serious accidents.

To avoid the various problems caused by fouling and slagging, a lot of research has been made on the mechanism of fouling and slagging by scholars at home and abroad and a plurality of slagging determination indexes have been proposed by the scholars which confront many limitations in the actual application and therefore only serve for a preliminary determination but cannot fundamentally eliminate the damages caused by contamination to a boiler. A method is proposed to regulate the combustion in the furnace of a boiler to control the temperature in the furnace to relieve the slagging problem of the boiler, this method, which cannot be operated conveniently in the actual application, is not popularized. For a high-alkalinity coal, the alkali metals volatilizing from the high-alkalinity coal are likely to condense on a boiler heating surface to form a bottom deposit which exists mainly in the form NaCl or $Na_2SO_4$. After volatilizing in a high-temperature environment, the foregoing components are likely to coagulate on a convective heat-absorbing surface to form a sintered or adhered ash deposit, the continuous absorption of the deposit to fly ash causes varying degrees of contamination to the convective heat-absorbing surface, moreover, the contaminants which cannot be removed using a soot blower reduce the heat transfer capability of the heat-absorbing surface, increase the temperature of the smoke discharged from the boiler and finally greatly reduce the output of the furnace of the boiler to shut down the boiler.

At present, there is a domestic lack of the engineering operation experience on the use of the combustion of a high-alkalinity coal, only several power plants in Xinjiang are studying the problem of the contamination caused by the combustion of a high-alkalinity coal but have not developed any effective high-alkalinity coal utilization method. The contamination problem can only be relieved through non-local coal blended combustion; non-local coal blended combustion is actually a method of reducing the relative content of the alkali metals contained in a raw coal by adding other low-alkalinity metal coals. The proportion of the high-alkalinity coal blended for combustion should be below 30%. When the proportion of the high-alkalinity coal blended for combustion is increased, the serious contamination caused by the ash deposit to the convective heat-absorbing surface generates a smoke passage, and the wash-out of smoke causes the leakage of a high temperature reheater and a high temperature superheater. As high-alkalinity coals are mainly used by electric power stations near coal-mines in Xinjiang, a high amount of non-local coals is needed for blended combustion, thus, this combustion mode is usually limited by transportation conditions and is therefore significantly increased in running cost. A platen superheater is arranged in the pulverized coal boiler of existing large power stations to reduce the outlet temperature of the furnace of the boiler and decrease molten slag, however, as relatively low in melting point, some alkali metal salts in smoke are still slagged when flowing through a convective heat-absorbing surface, the slagging phenomenon gets specifically worse in the combustion of Zhundong coal containing high-alkalinity metals. Advantaged in wide fuel applicability range, high combustion efficiency and few polluting emissions, circulating fluidized bed boiler has been rapidly developed in the past dozen years and widely commercially applied in the field of power station boilers. When a circulating fluidized bed burns a high-alkalinity coal as a power coal, the contamination to a convective heat-absorbing surface is also severe. The existence of slagging and fouling limits the large-scale efficient utilization of high-alkalinity coals and consequentially restricts the utilization efficiency of the energies of China.

SUMMARY OF THE INVENTION

To address the problem of the contamination to the convective heat-absorbing surface of existing power station boiler, the disclosure provides a pyrolysis-combustion dual-bed system for eliminating the contamination caused by the combustion of a high-sodium coal which is simply structured to guarantee the full heat exchange of a boiler heating surface, stabilize the output of a boiler, prevent the temperature of the convective heat-absorbing surface from being overhigh for contamination to greatly reduce the probability of the occurrence of a pipe bursting accident and realize the large-scale pure combustion of high-alkalinity coals.

To address the technical problem above, the technical solution of the disclosure is as follows:

a pyrolysis-combustion dual-bed system for eliminating the contamination caused by the combustion of a high-sodium coal comprises a fluidized bed, a cyclone separator, a coal ash distributor, an ash-coal mixer, a lower pyrolysis bed, an external bed, a return feeder and a cleaner, wherein the cyclone separator is connected with an upper lateral side of the fluidized bed so that the high-temperature coal ash from the fluidized fed enters the cyclone separator, the outlet end of the cyclone separator is connected with the inlet end of the coal ash distributor which is provided with two outlets one of which is connected with the inlet of the return feeder and the other one of which is connected with the inlet of the ash-coal mixer; the outlet of the ash-coal mixer is connected with the inlet of the lower pyrolysis bed; the lower pyrolysis bed is provided with two outlets one of which is connected with the inlet of the external bed and the other one of which is connected with the inlet of the cleaner; the outlet of the external bed is connected with the inlet of the return feeder; the return feeder close to the lower lateral side of the fluidized bed is connected with the inlet on the lower lateral side of the fluidized bed; and the outlet of the cleaner is connected with the inlet of the lower lateral side of the fluidized bed.

A heat exchanger is arranged behind the cyclone separator and connected with a draught fan which is connected with a chimney.

The ash-coal mixer feeds coal via a feeder which is connected with the ash-coal mixer, and the feeder is provided with a coal hopper.

The working process of the system is as follows:

the upper end of the fluidized bed enters the cyclone separator; the high-temperature coal ash from the cyclone separator is fed into the coal ash distributor, one part of the high-temperature coal ash enters the return feeder, and the other part of the high-temperature coal ash enters the ash-coal mixer; meanwhile, raw coal is fed into the ash-coal mixer through a coal hopper and a feeder to be mixed with the high-temperature coal ash in the coal-ash mixer; the mixture of the coal and the coal ash enters the lower pyrolysis bed to be pyrolyzed, the pyrolyzed coal and coal ash enters the external bed by means of which pyrolyzed particles of the coal and the coal ash are combusted and exchanged in heat, the coal and the coal ash passing the external bed enter the return feeder; the high-temperature coal ash not passing the lower pyrolysis bed and the pyrolyzed and mixed coal and coal ash are both fed into the furnace chamber of the fluidized bed to be combusted, wherein the pyrolysis gas produced by the lower pyrolysis bed first passes the cleaner to be sodium-removed and then enters the fluidized bed to be combusted.

The working principle of the system is as follows:

in a circulating fluidized bed boiler burning high-alkalinity coals, raw coal is pyrolyzed by means of circulating hot ash before entering the furnace chamber of a boiler so as to make full use of energies, in this way, not only volatilizable Na can be removed but also the content of the Na contained in the coal is reduced, thus lowering the content of the active Na in smoke and reducing the amount of the sodium salts adhered and deposited on the convective heat-absorbing surface of the boiler and consequentially reducing the contamination to the convective heat-absorbing surface.

The disclosure has the following beneficial effects:

(1) on the premise of keeping the basic form of a boiler unchanged, by using a dual-bed system to first pyrolyze fuel coal in a lower pyrolysis bed to volatilize alkali metals into pyrolysis gas at a high temperature, the disclosure reduces the content of the alkali metals contained in the coal entering the furnace of a fluidized bed, as there are few alkali metals in the smoke resulting from a combustion process, the disclosure fundamentally eliminates the source of a contamination phenomenon, and by removing volatilizable Na through pyrolysis, the disclosure lowers the content of the Na element contained in the coal, reduces the contamination to the convective heat-absorbing surface of the boiler, improves the heat exchange efficiency of a heat exchange surface and stabilizes the output of the boiler;

(2) the pulverized coal ash heat carrier involved in the disclosure comes from the coal ash generated from the combustion in a boiler, and heat is also offered by the coal ash heat carrier, thus solving the gas-solid separation needed in gas heating; and only by adding a pulverized coal pyrolysis device, the problem of the contamination to a convective heat-absorbing surface can be solved or greatly relieved without using any external heat source while the running cost is nearly not increased, the running time of a power plant is prolonged, the running efficiency of the power plant is increased; the high cost brought by the utilization of high-alkalinity coals merely through blended combustion is avoided;

(3) the dual-bed system adopted in the disclosure only requires the addition of a lower pyrolysis bed, not modifying existing boiler greatly, thus, the large-scale pure combustion of high-alkalinity coals can be realized to increase the benefit of power plants at a relatively low device investment;

(4) pyrolyzed particles are combusted and heat-exchanged using an external bed, which is beneficial to prolonging the retention time of the particles and increasing combustion efficiency;

(5) compared with a method of eliminating the contamination caused by the combustion of a high-alkalinity coal such as Zhundong coal by blending low-alkalinity coals or additives for combustion, the disclosure solves problems such as the transportation cost of pulverized coal or additives needed for blended combustion.

BRIEF DESCRIPTION OF DRAWINGS

FIG. 1 is a schematic diagram illustrating the structure of a system according to the disclosure.

Explanation of reference signs in FIG. 1: 1 coal hopper; 2 feeder; 3 blower; 4 fluidized bed; 5: cyclone separator; 6 coal ash distributor; 7 heat exchanger; 8 draught fan; 9 chimney; 10 coal hopper; 11 feeder; 12 ash-coal mixer; 13 cleaner; 14 lower pyrolysis bed; 15 external bed; 16 return feeder.

DETAILED DESCRIPTION OF THE EMBODIMENTS

As shown in FIG. 1, a dual-bed system for preventing a boiler heating surface from being contaminated comprises a fluidized bed 4, a cyclone separator 5, a coal ash distributor 6, an ash-coal mixer 12, a lower pyrolysis bed 14, a return feeder 16 and a cleaner 13. The cyclone separator 5 is connected with an upper lateral side of the fluidized bed 4 so that the high-temperature coal ash from the fluidized bed 4 enters the cyclone separator 5, the outlet end of the cyclone separator 5 is connected with the inlet end of the coal ash distributor 6 which is provided with two outlets one of which is connected with the inlet of the return feeder 16 and the other one of which is connected with the inlet of the ash-coal mixer 12. The outlet of the ash-coal mixer 12 is connected with the inlet of the lower pyrolysis bed 14; the lower pyrolysis bed 14 is provided with two outlets one of which is connected with the inlet of the external bed 15 and the other one of which is connected with the inlet of the cleaner 13; the outlet of the external bed 15 is connected with the inlet of the return feeder 16; the return feeder 16 close to the lower lateral side of the fluidized bed 4 is connected with the inlet on the lower lateral side of the fluidized bed 4; and the outlet of the cleaner 13 is connected with the inlet of the lower lateral side of the fluidized bed 4.

A heat exchanger 7 is arranged behind the cyclone separator 5 and connected with a draught fan 8 which is connected with a chimney 9.

Coal is fed into the ash-coal mixer 12 via a feeder which is connected with the ash-coal mixer 12, and the feeder 11 is provided with a coal hopper 10.

The cleaner 13 may be a filter.

The working process of the whole system is as follows:

As shown in FIG. 1, in the initial operation phase of a boiler, a non-local coal may be blended or external ash may be added through the coal hopper 1 and the feeder 2 until the boiler runs normally and generates a given amount of coal ash, then the coal ash generated by the boiler is used to pyrolyze the raw coal from the coal hopper 10 and the feeder 11. The feeding of the coal using the coal hopper 1 and the feeder 2 can be stopped after the lower pyrolysis bed 14 runs normally. When the boiler runs normally, the semi-cake resulting from the pyrolysis is combusted with the air from the blower 3 in the furnace chamber of the fluidized bed 4, and the resulting coal ash and smoke enters the separator 5 to be separated. After the temperature of the separated smoke is reduced by the heat exchanger 7, the smoke is discharged into the air by the draught fan 8 through the chimney 9. The separated coal ash enters the distributor 6 to be divided into two parts according to the need of the lower pyrolysis bed 14, one part of the coal ash is directly returned to the furnace of the fluidized bed 4 by the return feeder 16 while the other part of the coal ash enters the mixer 12 to be mixed with the high-alkalinity coal from the coal hopper 10 and the feeder 11. The hot ash and the high-alkalinity coal uniformly mixed in the mixer 12 enter the lower pyrolysis bed 14 to be pyrolyzed; after the solids contained in the gas resulting from the pyrolysis are removed by the cleaner 13, the gas is subjected to a subsequent processing such as cooling, the pyrolyzed hot ash and high-alkalinity semi-cake enters the external bed 15 so that pyrolyzed particles are combusted and exchanged in heat, then the hot ash and high-alkalinity semi-cake enters the return feeder 16. The hot ash and high-alkalinity semi-cake entering the return feeder 16 is fed into the fluidized bed 4 by smoke so as to be combusted in the furnace of the fluidized bed 4. The slag discharging of the boiler is carried out on the bottom of the fluidized bed 4. Most of volatilizable sodium is removed after the high-alkalinity coal is pyrolyzed in the lower fluidized bed 14, as the sodium content of the coal is reduced, the content of the active sodium contained in the smoke resulting from the combustion carried out in the chamber of the fluidized bed 4 is greatly reduced, thus there is almost no contamination caused when the smoke passes the subsequent heat-absorbing surface.

The invention claimed is:

1. A pyrolysis-combustion dual-bed system for eliminating the contamination caused by the combustion of a high-sodium coal, comprising: a fluidized bed, a cyclone separator, a coal ash distributor, an ash-coal mixer, a lower pyrolysis bed, a return feeder and a cleaner, wherein the cyclone separator is connected with an upper lateral side of the fluidized bed so that the high-temperature coal ash from the fluidized bed enters the cyclone separator, the outlet end of the cyclone separator is connected with the inlet end of the coal ash distributor which is provided with two outlets one of which is connected with the inlet of the return feeder and the other one of which is connected with the inlet of the ash-coal mixer; the outlet of the ash-coal mixer is connected with the inlet of the lower pyrolysis bed; the lower pyrolysis bed is provided with two outlets one of which is connected with the inlet of an external bed and the other one of which is connected with the inlet of the cleaner; the outlet of the external bed is connected with the inlet of the return feeder; the return feeder close to the lower lateral side of the fluidized bed is connected with the inlet on the lower lateral side of the fluidized bed; and the outlet of the cleaner is connected with the inlet of the lower lateral side of the fluidized bed.

2. The system according to claim 1, wherein a heat exchanger is arranged behind the cyclone separator and connected with a draught fan which is connected with a chimney.

3. The system according to claim 1, wherein coal is fed into the ash-coal mixer via a feeder which is connected with the ash-coal mixer, and a coal hopper is arranged on the feeder.

4. The system according to claim 1, wherein the working process of the system is as follows: the upper end of the fluidized bed is connected with the cyclone separator; the high-temperature coal ash from the cyclone separator is fed into the coal ash distributor, one part of the high-temperature coal ash enters the return feeder, and the other part of the high-temperature coal ash enters the ash-coal mixer; meanwhile, raw coal is fed into the ash-coal mixer through a coal hopper and a feeder to be mixed with the high-temperature coal ash in the ash-coal mixer; the mixture of the coal and the coal ash enters the lower pyrolysis bed to be pyrolyzed, the pyrolyzed coal and coal ash enters the external bed via which pyrolyzed particles of the coal and the coal ash are combusted and exchanged in heat, the coal and the coal ash passing the external bed enter the return feeder; the high-temperature coal ash not passing the lower pyrolysis bed and the pyrolyzed and mixed coal and coal ash are both fed into the furnace chamber of the fluidized bed through the return feeder to be combusted, wherein the pyrolysis gas produced by the lower pyrolysis bed first passes the cleaner to be sodium-removed and then enters the fluidized bed to be combusted.

5. A pyrolysis-combustion dual-bed system for eliminating the contamination caused by the combustion of a high-sodium coal, comprising: a fluidized bed, a cyclone separator, a coal ash distributor, an ash-coal mixer, a lower pyrolysis bed and a return feeder, wherein the coal ash from the fluidized bed is fed into the cyclone separator, the outlet end of the cyclone separator is connected with the inlet end of the coal ash distributor which is provided with two outlets one of which is connected with the inlet of the return feeder and the other one of which is connected with the inlet of the ash-coal mixer; the outlet of the ash-coal mixer for mixing the coal ash with a high-alkalinity coal is connected with the inlet of the lower pyrolysis bed; and the outlet of the lower pyrolysis bed is connected with the fluidized bed through the return feeder, the lower pyrolysis bed further provided with a cleaner for cleaning pyrolysis gas, the outlet of the cleaner is connected with the lower lateral side of the fluidized bed.

6. The system according to claim 5, wherein an external bed is further arranged between the outlet of the lower pyrolysis bed and the return feeder.

7. The system according to claim 5, wherein the ash-coal mixer feeds the high-alkalinity coal through the feeder which is provided with a coal hopper.

8. The system according to claim 5, wherein a heat exchanger is further arranged behind the cyclone separator, the heat exchanger is connected with a draught fan connected with the chimney.

9. The system according to claim 5, wherein the cyclone separator is connected with an upper lateral side of the fluidized bed.

10. The system according to claim 5, wherein the return feeder is connected with an upper lateral side of the fluidized bed.

11. A pyrolytic combustion method for eliminating the contamination caused by the combustion of a high-alkalinity coal, comprising the following steps:

(a) generating a given amount of coal ash and smoke by a normally running fluidized bed;

(b) pyrolyzing the high-alkalinity coal using the coal ash outside the fluidized bed, the gas resulting from the pyrolysis is filtered to remove the solids contained in the gas so as to remove alkali metals, the gas resulting from the pyrolysis is processed and then fed into the fluidized bed; and (c) feeding the pyrolyzed high-alkalinity coal into the fluidized bed for combustion.

12. The pyrolytic combustion method according to claim 11, wherein before step (a) is carried out, the fluidized bed runs in a non-local coal blending or external ash and slag addition manner.

13. The pyrolytic combustion method according to claim 11, wherein after step (a) is carried out, the coal ash and the smoke are separated.

14. The pyrolytic combustion method according to claim 13, wherein after the temperature of the separated smoke is reduced, the smoke is discharged into the air.

15. The pyrolytic combustion method according to claim 13, wherein the separated coal ash is divided into two parts: one part is directly returned to the furnace of the fluidized bed, and one part is mixed with the high-alkalinity coal.

16. The pyrolytic combustion method according to claim 11, wherein after step (b) is carried out, the pyrolyzed particles in the hot ash and high-alkalinity semi-cake resulting from the pyrolysis are combusted and exchanged in heat.

* * * * *